US009695639B2

(12) United States Patent
Vincent et al.

(10) Patent No.: US 9,695,639 B2
(45) Date of Patent: Jul. 4, 2017

(54) SINGLE TRIP CEMENT THRU OPEN HOLE WHIPSTICK

(71) Applicant: BAKER HUGHES INCORPORATED, Houston, TX (US)

(72) Inventors: Ray P. Vincent, Houston, TX (US); Nicholas K. Tonti, San Antonio, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 447 days.

(21) Appl. No.: 14/073,238

(22) Filed: Nov. 6, 2013

(65) Prior Publication Data

US 2015/0122495 A1 May 7, 2015

(51) Int. Cl.
*E21B 7/06* (2006.01)
*E21B 33/13* (2006.01)

(52) U.S. Cl.
CPC ..... *E21B 7/061* (2013.01); *E21B 33/13* (2013.01)

(58) Field of Classification Search
None
See application file for complete search history.

(56) References Cited

U.S. PATENT DOCUMENTS

| | | | | |
|---|---|---|---|---|
| 5,318,132 | A | 6/1994 | Odorisio | |
| 5,474,126 | A | 12/1995 | Lynde et al. | |
| 5,806,596 | A | 9/1998 | Hardy et al. | |
| 5,909,770 | A | 6/1999 | Davis | |
| 6,484,803 | B1 * | 11/2002 | Gremillion | E21B 17/1028 166/241.1 |
| 8,459,345 | B2 | 6/2013 | Bell | |
| 2008/0000642 | A1 * | 1/2008 | Mailand | E21B 33/068 166/305.1 |
| 2010/0025036 | A1 * | 2/2010 | Gambier | E21B 33/127 166/277 |
| 2012/0255785 | A1 | 10/2012 | Gregurek et al. | |
| 2013/0213654 | A1 | 8/2013 | Dewey et al. | |
| 2015/0068809 | A1 * | 3/2015 | Adams | E21B 10/02 175/58 |

FOREIGN PATENT DOCUMENTS

| | | |
|---|---|---|
| WO | 03083250 | 10/2003 |

OTHER PUBLICATIONS

International Searching Authority; International Search Report and Written Opinion; issued in PCT/US2014/061897 dated Jan. 28, 2015.

* cited by examiner

*Primary Examiner* — Caroline Butcher
(74) *Attorney, Agent, or Firm* — Parsons Behle & Latimer

(57) ABSTRACT

An assembly for use to cement an uncased wellbore and create a sidetrack of a wellbore with a single trip into the wellbore. The assembly includes a mill selectively connected to a whipstock. A snorkel tube is positioned within a bore of the mill and within a bore of the whipstock. The assembly is connected to drill string and positioned within an openhole portion of the wellbore. After the assembly has been anchored, cement may be pumped down the drill string and through the snorkel tube. The mill may be removed from the whipstock by shearing a shearable device connecting the mill to the whipstock. The mill is used engage a diverting surface on the whipstock and create a sidetrack. The mill may also mill a portion of the snorkel tube or the snorkel tube may be removed from wellbore up the drill string prior to milling the sidetrack.

22 Claims, 7 Drawing Sheets

SINGLE TRIP CEMENT THRU OPEN HOLE WHIPSTICK

FIELD OF THE DISCLOSURE

The embodiments described herein relate to an assembly and method for cementing an uncased or openhole portion of a wellbore through an assembly and producing a sidetrack of the wellbore with a single trip of the assembly into the wellbore. The assembly comprises a mill selectively connected to a whipstock with a snorkel tube positioned within a bore of the mill and a bore of the whipstock. Cement may be pumped down a drill string and through the snorkel tube to cement a portion of uncased wellbore. After cementing the wellbore, the mill may be removed from the assembly and used to provide a sidetrack of the wellbore without requiring a separate trip into the wellbore.

BACKGROUND

Description of the Related Art

It may be desired to produce a sidetrack in an uncased portion of a wellbore. First the uncased portion of the wellbore needs to be cemented. A cementing assembly may be connected to a drill string and run down the wellbore until it is positioned into uncased portion of the wellbore. The entire wellbore may be uncased or the lower portion below the casing may be uncased. Cement is pumped down the drill string and out the assembly to cement the uncased portion of the wellbore. After cementing the uncased bore of a wellbore, the drill string may be removed from the wellbore and a mill may be run down the wellbore. When the mill is positioned adjacent to the newly cemented portion of the wellbore, the mill will be actuated and moved downward. The mill will continue to travel down the wellbore until it engages a whipstock, which changes the direction of the mill causing it produce a sidetrack of the wellbore.

The repeated trips down the wellbore to positioned the cementing assembly, remove the drill string, and positioned the mill above the whipstock are time consuming and costly. It would be beneficial to reduce the amount of time required to produce a sidetrack of the wellbore.

SUMMARY

The present disclosure is directed to a method and system for cementing a portion of an uncased wellbore and milling a sidetrack to the wellbore with a single trip assembly.

One embodiment is an assembly for use to cement an uncased wellbore comprising a whipstock having a bore and a deflection surface to deflect a mill to move substantially lateral from the deflection surface, a mill having a bore and being selectively connected to an upper end of the whipstock, and a snorkel tube. The snorkel tube is positioned within the bore of the mill and positioned within the bore of the whipstock. Cement may be pumped through the snorkel tube to a location below the whipstock.

The snorkel tube may be comprised of a drillable material. The drillable material may be comprised of aluminum or a composite material. The assembly may include a seal sub having a bore and being connected to the bottom end of the whipstock. The snorkel tube may extend into the bore of the seal sub. The assembly may include a pup joint having a bore connected beneath the seal sub. The snorkel tube may extend into the bore of the pup joint. The assembly may include an open hole anchor having a bore in communication with the snorkel tube and the anchor may be connected beneath the pup joint.

The assembly may include a landing collar connected beneath the open hole anchor. The landing collar may include a bore in communication with the bore of the open hole anchor. The assembly may include a float collar connected beneath the landing collar. The float collar may have a bore in communication with the bore of the landing collar. The assembly may include a tail pipe connected beneath the float collar. The tail pipe may have a bore in communication with the bore of the float collar. Cement may be pumped through the snorkel tube, the open hole anchor, the landing collar, the float collar, and out the tail pipe.

A shearable device may selectively connect the mill to the upper end of the whipstock. A plug may be pumped down a drill string to land within the bore of the mill. The end of the plug may comprise a cutting structure. A locking device may selectively secure the snorkel tube within the bore of the mill. A release device may be pumped down a drill string to selectively unlock the locking device that selectively secures the snorkel tube within the bore of the mill. The unlocked locking device may prevent the downward movement of the snorkel tube within the bore of the mill, but may permit the upward movement of the snorkel tube within the bore of the mill. The snorkel tube may include a fin or a plurality of fins on an exterior surface. The upper end of the snorkel tube may include a profile that permits the removal of the snorkel tube from the bore of the mill via a slickline, wireline, or a braided line.

One embodiment is a method of cementing through a whipstock and creating a sidetrack to a wellbore in a single trip. The method comprises running an assembly connected to a drill string into a wellbore. The assembly comprises a mill selectively connected to an upper end of a whipstock, a snorkel tube positioned within a bore of the mill and positioned within a bore of the whipstock, an open hole anchor having a bore in communication with the snorkel tube, and a tail pipe connected beneath the open hole anchor, the tail pipe having a bore in communication with the snorkel tube. The method includes setting the open hole anchor within an open hole portion of the wellbore and pumping cement down the drill string, through the snorkel tube, and out the tail pipe. The method includes releasing the mill from the upper end of the whipstock and cutting a sidetrack in the wellbore with the mill.

The method may include shearing a shearable device that selectively connected the mill to the upper end of the whipstock. The method may include cutting off a portion of the snorkel tube with the mill prior to cutting the sidetrack in the wellbore. The method may include pumping a plug down the drill string after releasing the mill from the upper end of the whipstock. The end of the plug may comprise a cutting surface. The method may include landing the plug in the bore of the mill and cutting off a portion of the snorkel tube with the mill prior to cutting the sidetrack in the wellbore.

The method may include pumping a release device down the drill string to selectively release the snorkel from the bore of the mill after releasing the mill from the upper end of the whipstock. The release device may permit the snorkel tube to move upwards within the bore of the mill and may prevent the snorkel tube to move downwards within the bore of the mill. The method may include pumping the snorkel tube up the drill string prior to cutting the sidetrack in the wellbore. The method may include retrieving the snorkel tube from the bore of the mill after releasing the mill from the whipstock and prior to cutting the sidetrack in the wellbore. The method may include engaging a profile on an upper end of the snorkel tube with wireline, slickline, or a braided line.

One embodiment is a method of cementing an openhole wellbore through a whipstock and creating a sidetrack in a single trip. The method includes running an assembly connected to a drill string into a wellbore. The assembly comprises a mill selectively connected to an upper end of a whipstock by a shearable device, a snorkel tube positioned within a bore of the mill and positioned within a bore of the whipstock, and an open hole anchor, wherein the drill string is connected to the mill. The method includes setting the open hole anchor within an open portion of the wellbore and pumping cement down the drill string and through the snorkel tube and the open hole anchor to cement a portion of the open hole wellbore. The method includes shearing the shearable device to release the mill from the upper end of the whipstock and moving the mill uphole within the wellbore. The method includes milling a portion of the snorkel tube that extends above the whipstock, engaging a diverting surface of the whipstock with the mill, and cutting a sidetrack in the wellbore with the mill.

Figure 1:
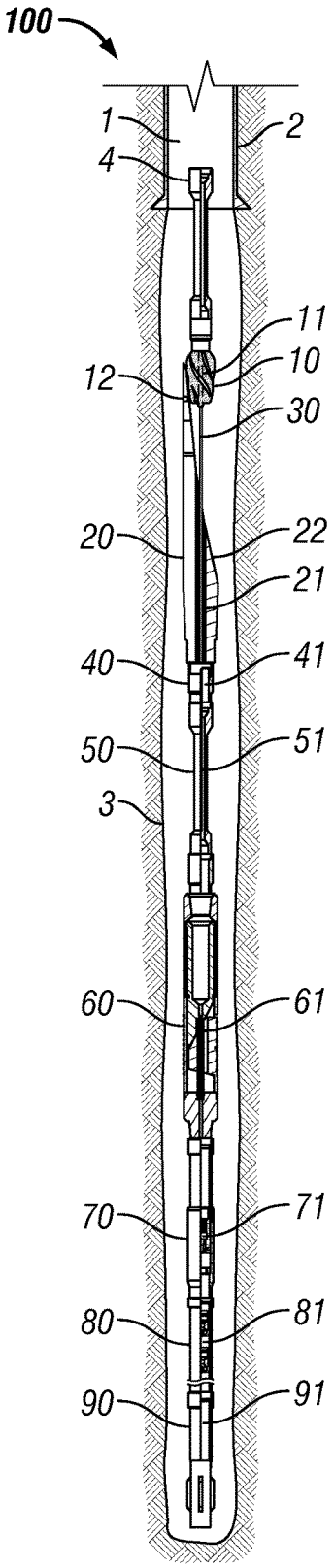
FIG. 1 shows an embodiment of an assembly that anchored in an uncased wellbore, cemented through, and produce a sidetrack bore in a single trip of the assembly.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
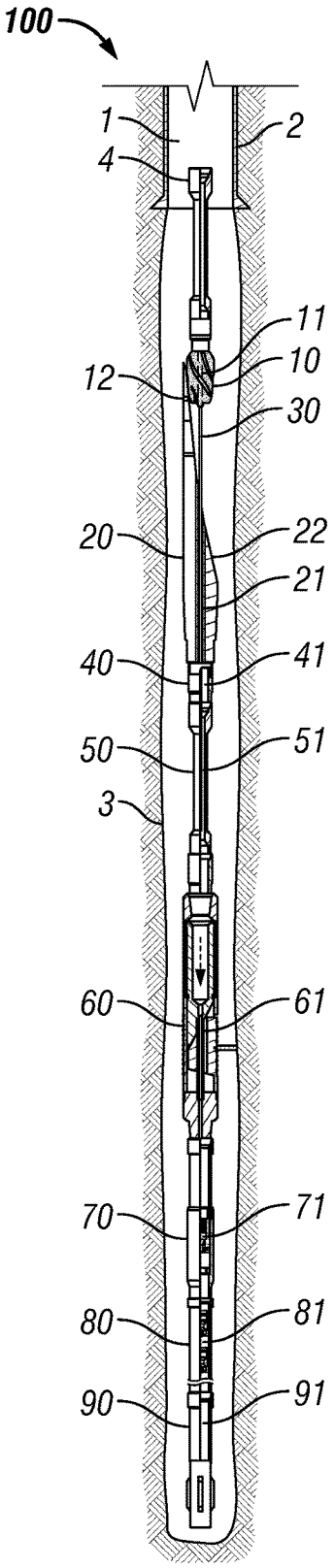
FIG. 2 shows the assembly of FIG. 1 with an anchor of the assembly being actuated.

FIG. 1 shows an assembly 100 connected to a drill string 4 within a wellbore 1. The drill string 4 will be run into the wellbore 1 and down the casing 2 within the wellbore 1 until the assembly 100 is positioned within an uncased or open-hole portion 3 of the wellbore 1. In some embodiments, the entire wellbore may be uncased. Once the assembly 100 is positioned at the desired location within an uncased portion 3 of the wellbore, an open hole anchor 60 may be actuated to retain the assembly 100 at the desired location as shown in FIG. 2.

The assembly 100 is comprised of a mill 10 that is selectively connected to a portion of a whipstock 20. A shearable device 12, such as a shear bolt, may be used to selectively connect the mill 10 to the whipstock 20. The bottom portion of the whipstock 20 may be connected to seal sub 40 that is connected to an open hole anchor 60 via a pup joint 50. The assembly 100 may include a landing collar 70, a float collar 80, and a tail pipe 90 positioned below the open hole anchor 60.

Figure 3:
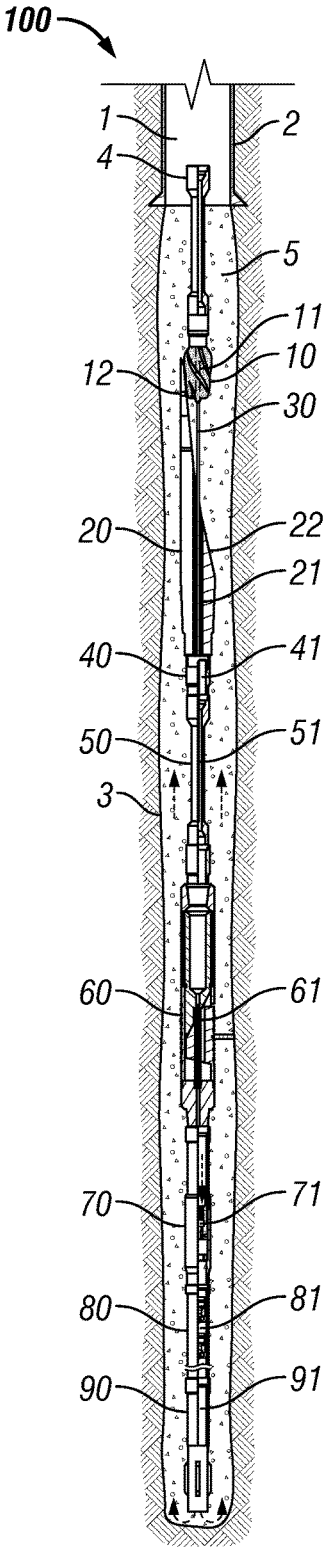
FIG. 3 shows the assembly of FIG. 1 with cement being pumped through the assembly into the uncased wellbore.

After the anchor 60 has been actuated to retain the assembly 100 at the desired location, cement 5 may be pumped down the drill string 4 and out the tail pipe 90 to cement the open hole portion 3 of the wellbore 1. The cement 5 is pumped down the drill string 4 and through a snorkel tube 30 positioned within a bore 11 of the mill 10. The snorkel tube 30 is also positioned within a bore 21 of the whipstock 20. The cement 5 travels down through the seal sub 40, pup joint 50, anchor 60, landing collar 70, float collar 80, and out the tail pipe 90 to cement the uncased portion 3 of the wellbore 1 as shown in FIG. 3.

Figure 4:
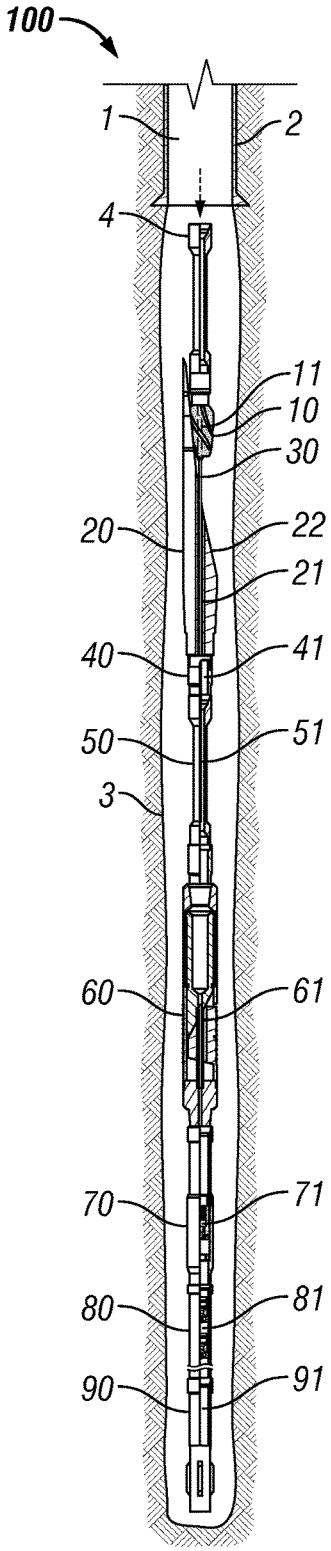
FIG. 4 shows the assembly of FIG. 1 with the mill of the assembly being released from the assembly by shearing a shearable device that selectively connects the mill to the whipstock of the assembly.

A downward force may be applied to the drill string 4 to shear the shearable device 12 releasing the mill 10 from the whipstock 20 as shown in FIG. 4. For illustrative purposes, the cement 5 is only shown in FIG. 3 to better show the operation of the mill 10 in regards to the rest of the assembly 100 and the wellbore 1.

Figure 5A:
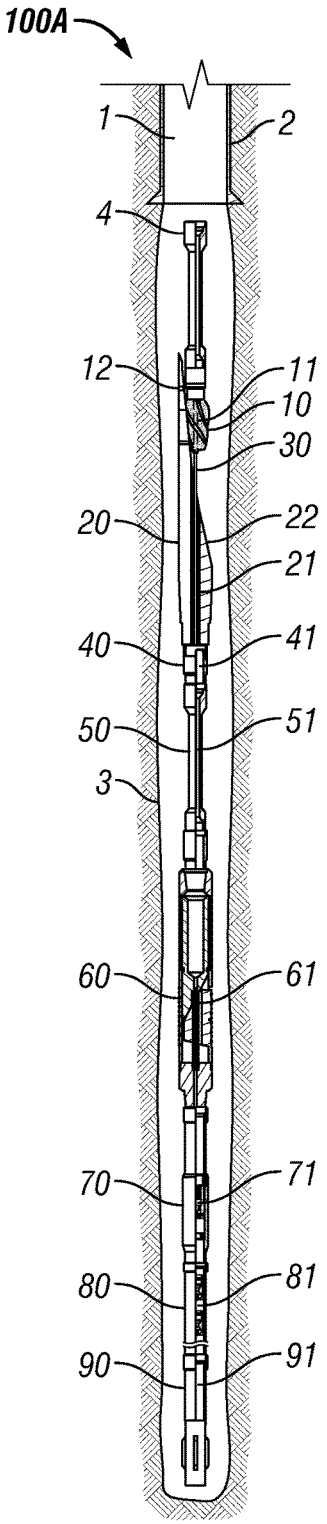
FIG. 5A shows one embodiment of an assembly that may be used to cement an uncased wellbore and produce a sidetrack in a single trip of the assembly.

FIG. 5A shows one embodiment of an assembly 100A that is comprised of a mill 10 having a bore 11 connected to a portion of a whipstock 20 via a shearable member 12. The whipstock 20 includes a bore 21 and an angled surface, also referred to as a diverting surface, 22 configured to divert the mill 10 in a direction substantially transverse to the axis of the wellbore. Upon deflection of the mill 10 by the diverting surface 22, the mill 10 will move in a transverse, or substantially lateral direction to form a sidetrack 6 (shown in FIG. 5C) of the wellbore 1 as discussed in detail herein. The use of a whipstock 20 and a mill 10 to produce a sidetrack 6 within a wellbore 1 is well known to one of ordinary skill in the art. The assembly 100A may include a seal sub 40 having a bore 41 connected to the bottom of the whipstock 20 and a pup joint 50 having a bore 51 connected to the seal sub 40. A snorkel tube 30 may be positioned within the bores 11 and 21 of the mill 10 and the whipstock 20. The snorkel tube 30 may also extended into the bores 41 and 51 of the seal sub 40 and the pup joint 50. The snorkel tube 30 is in fluid communication with the drill string 4.

In some embodiments, an open hole anchor 60 is positioned beneath the pup joint 50. The open hole anchor 60 may be actuated by dropping a ball down the drill string 4 until the ball seats within the landing collar 70. After the ball has seated, the pressure within the drill string 4 may slowly be increased until the anchor 60 is fully actuated. The pressure within the drill string 4 may continue to be increased to shear the ball through the landing collar 70. The drill string 4 may then be pulled and also set down to ensure that the anchor 60 is fully set within the uncased portion 3 of the wellbore 1. After the anchor 60 is fully set, cement may be pumped down the drill string 4 and out the tail pipe 90 to cement the uncased portion 3 of the wellbore 1. The bore 91 of the tail pipe 90 is in fluid communication with the drill string 4 via the snorkel tube 30 as well as the bore 81 of the float collar, the bore 71 of the landing collar 70, and the bore 61 of the anchor 60.

Figure 5B:
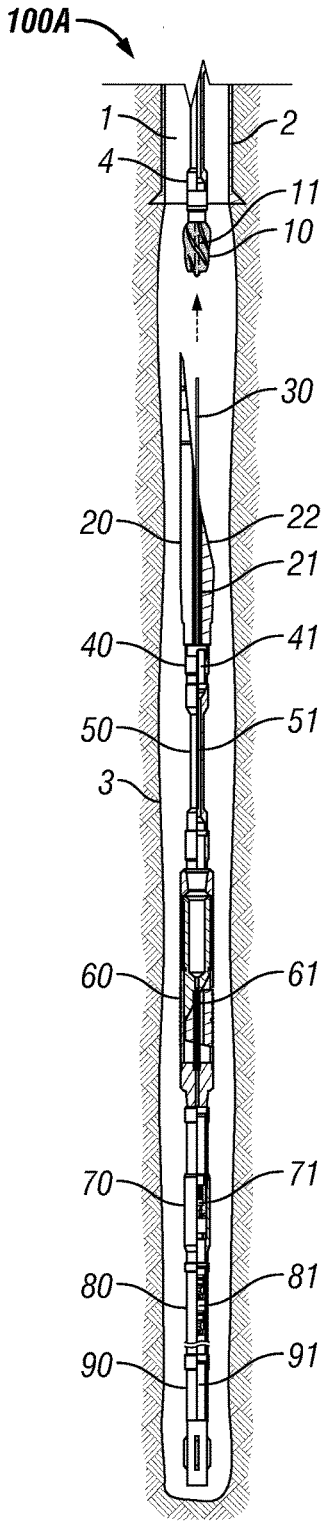
FIG. 5B shows the assembly of FIG. 5A with the mill removed from the assembly and positioned above snorkel tube.
Figure 5C:
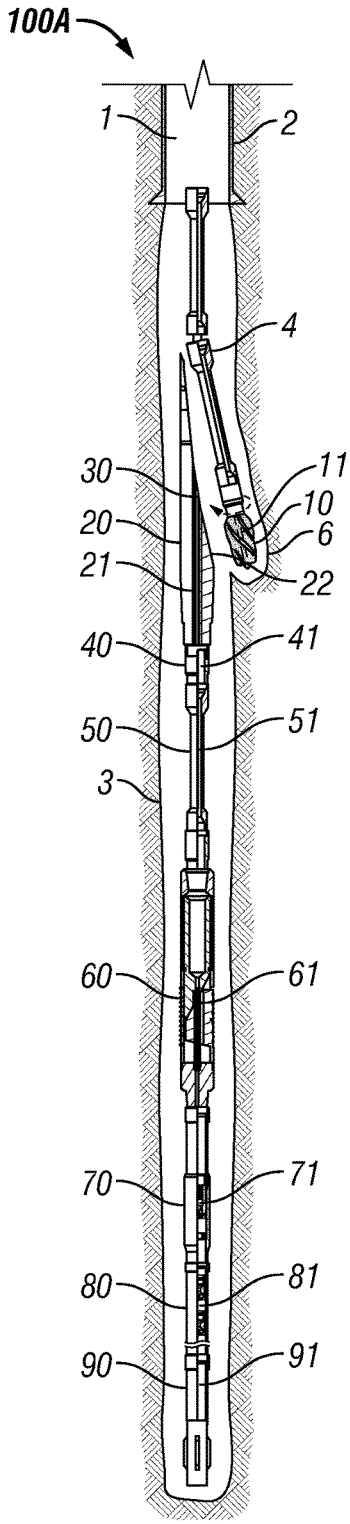
FIG. 5C shows the mill of the assembly of FIG. 5A producing a sidetrack.

After releasing the mill 10 from the whipstock 20, the drill string 4 may be pulled to raise the mill 10 above the end of the snorkel tube 30 as shown in FIG. 5B. The mill 10 may then be actuated to start rotating. The drill string 4 may then be lowered while pumping fluid down the drill string 4 and out the bore 11 of the mill 10. The mill 10 will be lowered to mill away the snorkel tube 30 until the mill 10 engages the deflection surface 22 of the whipstock 20, which causes the mill 10 to travel towards the edge of the wellbore 1 instead of traveling in a strictly downwards direction. The deflection surface 22 of the whipstock 20 causes the mill 10 to create a sidetrack 6 in the wellbore 1 as shown in FIG. 5C and as would be appreciated by one of ordinary skill in the art having the benefit of this disclosure.

Figures 6A, 6B, 6C:
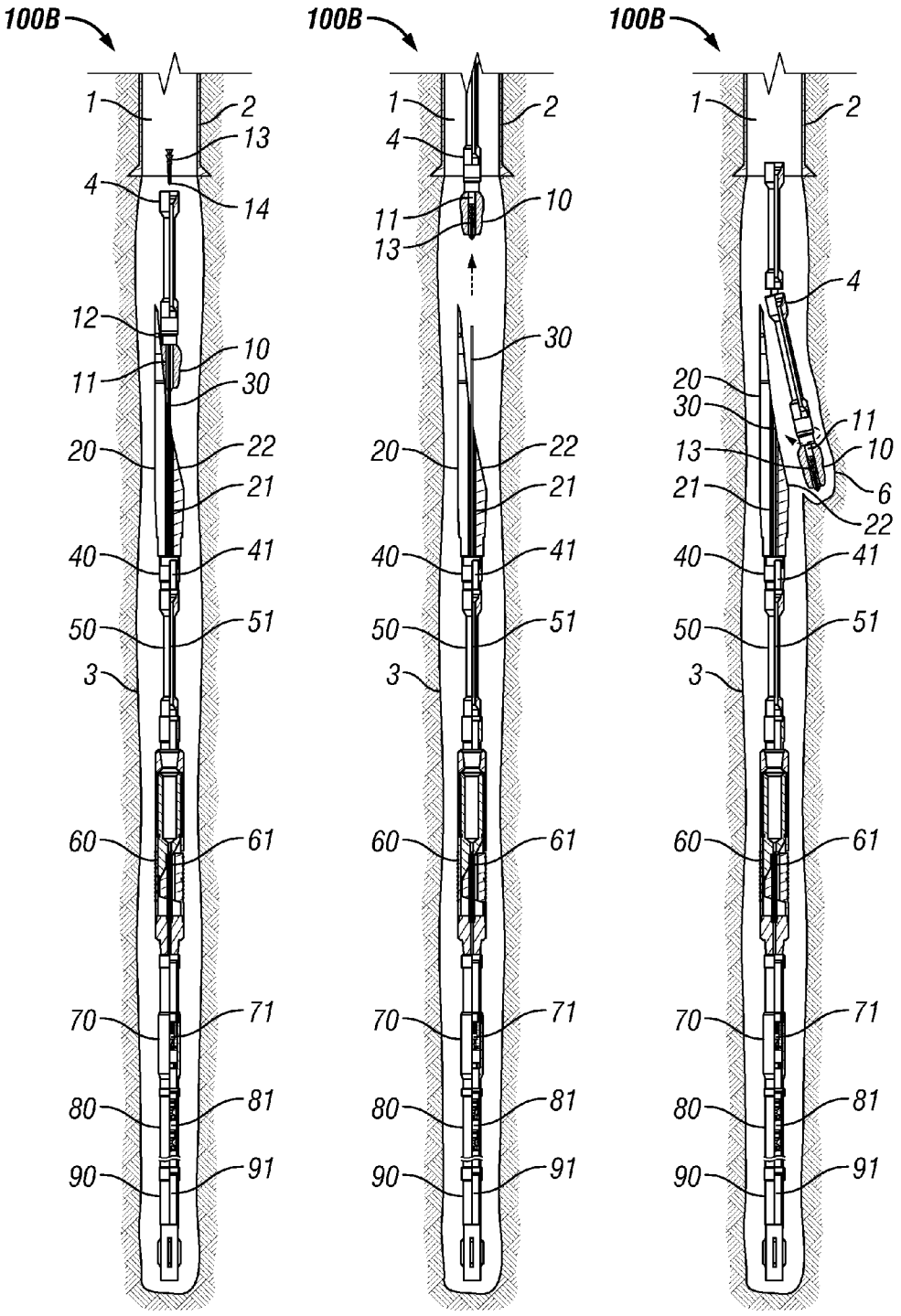
FIG. 6A shows one embodiment of an assembly that may be used to cement an uncased wellbore and produce a sidetrack in a single trip of the assembly.
FIG. 6B shows the assembly of FIG. 6A with the mill removed from the assembly and positioned above snorkel tube with a plug position within the bore of the mill.
FIG. 6C shows the mill of the assembly of FIG. 6A producing a sidetrack.

FIG. 6A shows an embodiment of an assembly 100B that may be used to cement an uncased hole 3 and bore a sidetrack 6 in a wellbore 1 in single trip. The assembly 100B contains components nearly identical to the assembly 100A of FIG. 5A. The assembly 100B includes a plug 13 that may be pumped down the drill string 4 after the mill has been detached from the assembly 100B as shown 6B. The plug 13 includes a cutting surface 14 on the end of the plug 13. The plug 13 is configured to be pumped down the drill string 4 and land in the bore 11 of the mill 10 so that the cutting surface 14 of the plug 13 can fill the bore 11 and create a more complete cutting structure on the end of the mill 11.

The drill string 4 may then be lowered while the mill 10 is actuated to mill away the snorkel tube 30 until the mill 10 engages the deflection surface 22 of the whipstock 20, which causes the mill 10 to travel towards the edge of the wellbore 1 instead of traveling in a strictly downwards direction. The deflection surface 22 of the whipstock 20 causes the mill 10 to create a sidetrack 6 in the wellbore 1 as shown in FIG. 6C and as would be appreciated by one of ordinary skill in the art having the benefit of this disclosure.

Figures 7A, 7B, 7C:
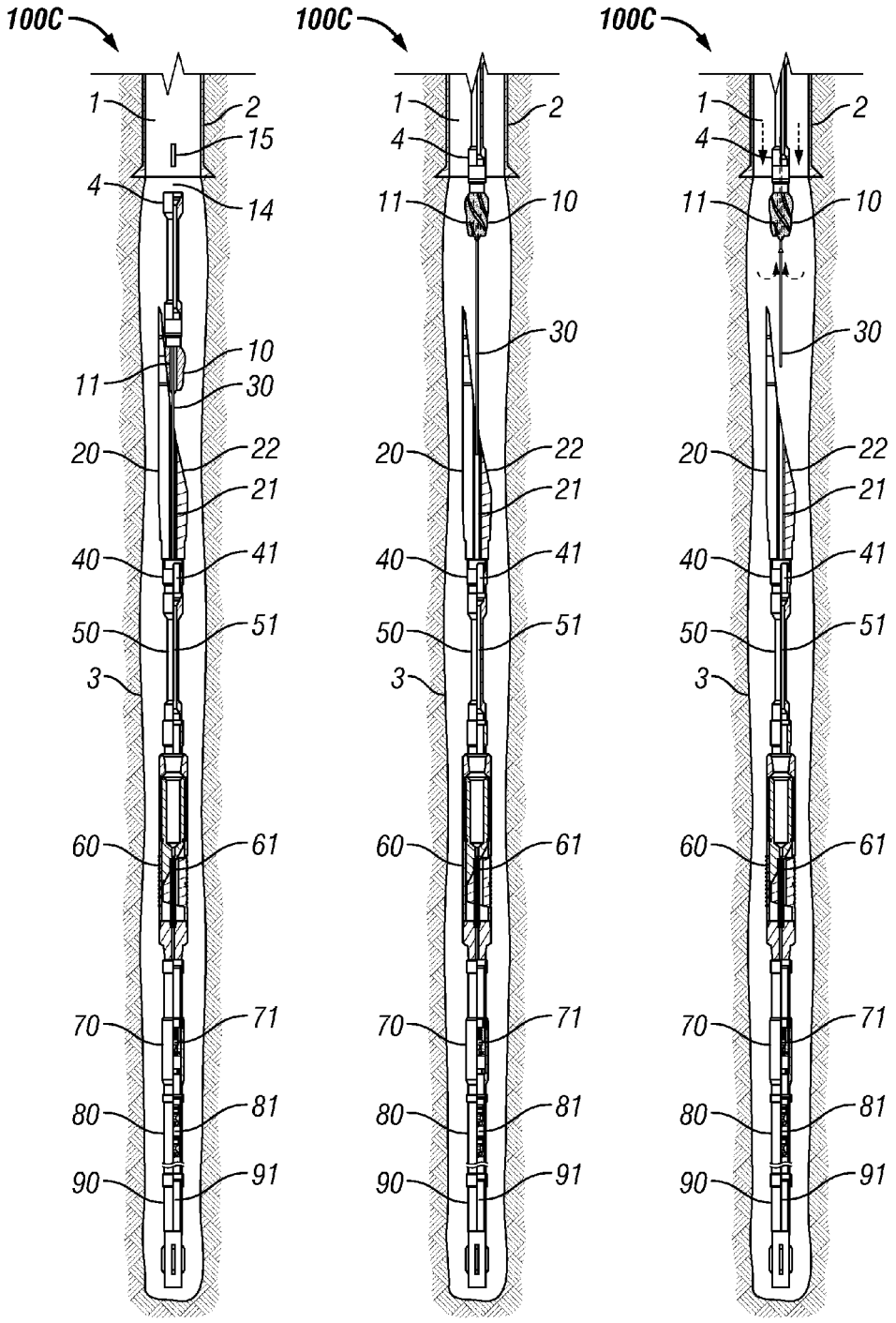
FIG. 7A shows one embodiment of an assembly that may be used to cement an uncased wellbore and produce a sidetrack in a single trip of the assembly.
FIG. 7B shows the assembly of FIG. 7A with the mill removed from the assembly with the snorkel tube retained within the bore of the mill.
FIG. 7C shows the reverse circulation of the snorkel tube of assembly of FIG. 7A.

FIG. 7A shows one embodiment of an assembly 100C that is comprised of a mill 10 having a bore 11 connected to a portion of a whipstock 20 via a shearable member 12. The whipstock 20 includes a bore 21 and an angled surface, also referred to as a diverting surface, 22 configured to divert the mill 10 in a direction substantially transverse to the axis of the wellbore. Upon deflection of the mill 10 by the diverting surface 22, the mill 10 will move in a transverse direction to be a sidetrack 6 (shown in FIG. 7D) of the wellbore 1 as discussed in detail herein.

After releasing the mill 10 from the whipstock 20, the drill string 4 may be pulled to raise the mill 10 pulling the snorkel tube 30 up with the mill 10 as shown in FIG. 7B. In the assembly 100C of FIGS. 7A-7C, the snorkel tube 30 is selectively connected within the bore 11 of the mill 10. A device 15, such as a release dart or bomb, may be dropped down the drill string 4 to selectively release the snorkel tube 30 from the bore 11 of the mill 10. The mill 10 may include may include a locking mandrel that selectively engages the snorkel tube and only permits the upwards movement of the snorkel tube 30 once unlocked. Various mechanisms may be employed to selectively retain the snorkel tube 30 and release the snorkel tube 30 permitting only upward movement within the mill 10 and drill string 4 as would be appreciated by one of ordinary skill in the art having the benefit of this disclosure. Likewise, various devices may be pumped down the drill string 4 to permit the release of the snorkel tube 30 from the locking mechanism as would be appreciated by one of ordinary skill in the art having the benefit of this disclosure.

Figure 7D:
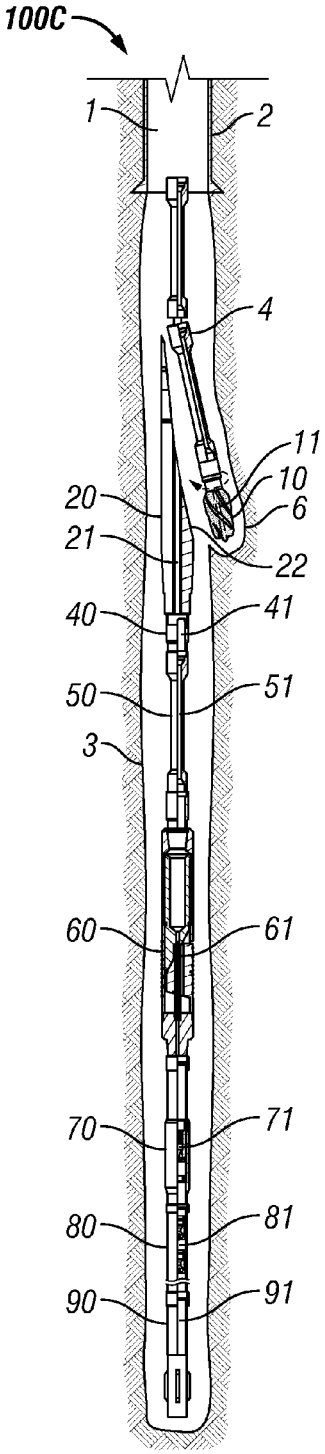
FIG. 7D shows the mill of the assembly of FIG. 7A producing a sidetrack.
Figure 7E:
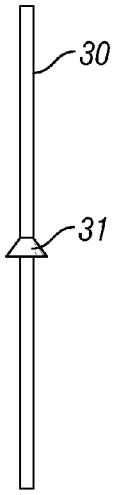
FIG. 7E shows an embodiment of a snorkel tube that may be used with the assembly of FIG. 7A.

After the device 15 has been pumped down the drill string 4 and released the snorkel tube 30, the snorkel tube 30 may be pumped up the drill string 4 by reverse circulation as shown in FIG. 7C. After removal of the snorkel tube 30 up the drill string 4, the mill 10 may then be actuated to start rotating. The drill string 4 may then be lowered while pumping fluid down the drill string 4 and out the bore 11 of the mill 10. The mill 10 will be lowered until the mill 10 engages the deflection surface 22 of the whipstock 20, which causes the mill 10 to travel towards the edge of the wellbore 1 instead of traveling in a strictly downwards direction. The deflection surface 22 of the whipstock 20 causes the mill 10 to create a sidetrack 6 in the wellbore 1 as shown in FIG. 7D and as would be appreciated by one of ordinary skill in the art having the benefit of this disclosure. As shown in FIG. 7E, the snorkel tube 30 may include fins 31, or a plurality of fins or projections, adapted to catch fluid to aid in the pumping of the snorkel tube 30 up the drill string 4.

Figure 8E:
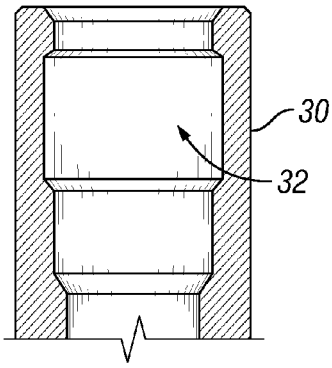
FIG. 8E shows an embodiment of a snorkel tubing having a retrieval profile.
Figure 8A:
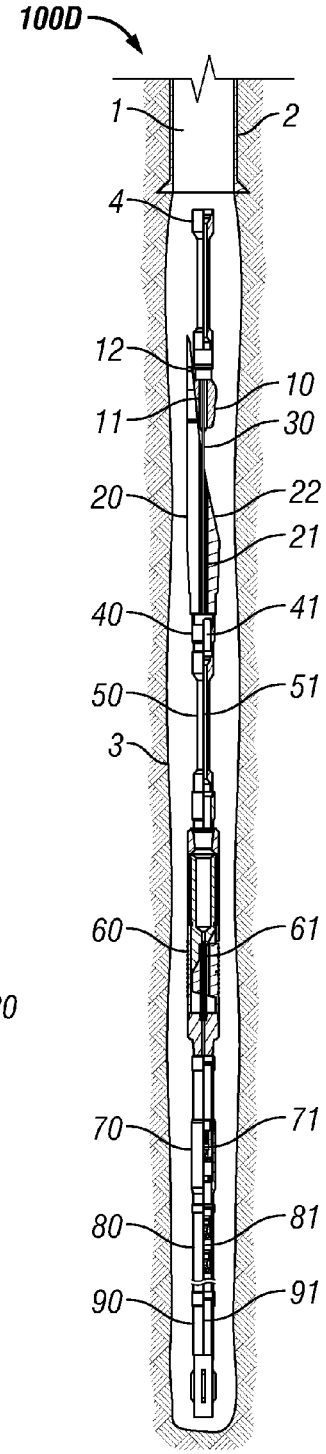
FIG. 8A shows one embodiment of an assembly that may be used to cement an uncased wellbore and produce a sidetrack in a single trip of the assembly.

FIG. 8A shows one embodiment of an assembly 100D that is comprised of a mill 10 having a bore 11 connected to a portion of a whipstock 20 via a shearable member 12. The whipstock 20 includes a bore 21 and an angled surface, also referred to as a diverting surface, 22 configured to divert the mill 10 in a direction substantially transverse to the axis of the wellbore. Upon deflection of the mill 10 by the diverting surface 22, the mill 10 will move in a transverse direction to be a sidetrack 6 (shown in FIG. 8D) of the wellbore 1 as discussed in detail herein.

Figures 8B, 8C, 8D:
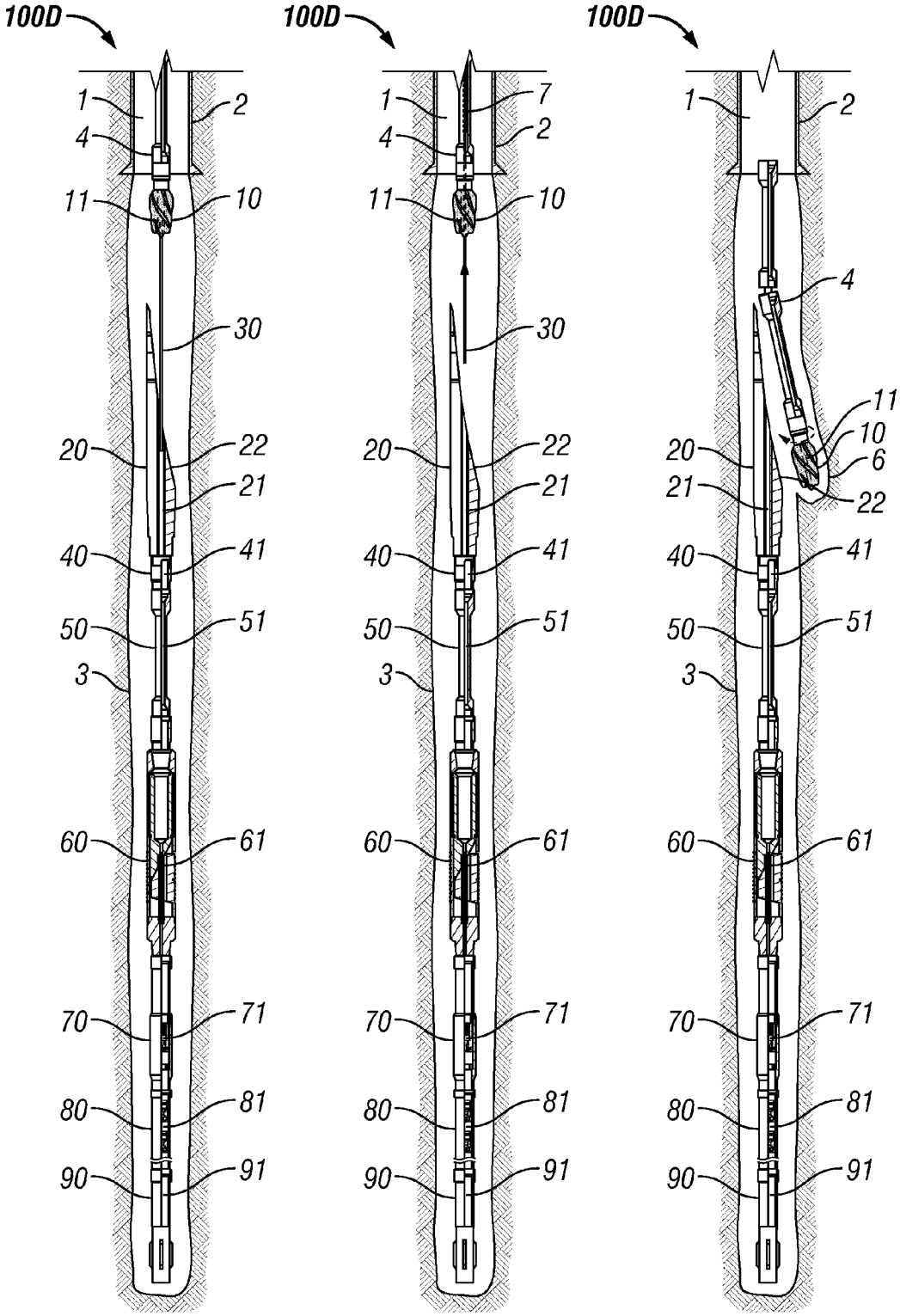
FIG. 8B shows the assembly of FIG. 8A with the mill removed from the assembly with the snorkel tube retained within the bore of the mill.
FIG. 8C shows the retrieval of the snorkel tube through the drill string of the assembly of FIG. 8A.
FIG. 8D shows the mill of the assembly of FIG. 8A producing a sidetrack.

After releasing the mill 10 from the whipstock 20, the drill string 4 may be pulled to raise the mill 10 pulling the snorkel tube 30 up with the mill 10 as shown in FIG. 8B. In the assembly 100D of FIGS. 8A-7C, the snorkel tube 30 is selectively retained within the bore 11 of the mill 10. As such, the snorkel tube 30 is raised with the mill 10 as the mill 10 is pulled uphole within the wellbore 1.

The top end of the snorkel tube 30 of assembly 100D includes a profile 32 as shown in FIG. 8E that is adapted to permit the retrieval of the snorkel tube 30 from the drill string 4. A wireline 7 may be run down the drill string 4 to engage the profile 32 of the snorkel tube 30 and pull the snorkel tube 30 to the surface through the drill string 4 as shown in FIG. 8C. The snorkel tube 30 may include various profiles other than the one shown in FIG. 8E that are adapted to permit the retrieval of the snorkel tube 30 through the drill string 4 by various means, such as wireline, slickline, braided line, or other various mechanisms.

After removal of the snorkel tube 30 up the drill string 4 via the wireline 7, the mill 10 may then be actuated to start rotating. The drill string 4 may then be lowered while pumping fluid down the drill string 4 and out the bore 11 of the mill 10. The mill 10 will be lowered until the mill 10 engages the deflection surface 22 of the whipstock 20, which causes the mill 10 to travel towards the edge of the wellbore 1 instead of traveling in a strictly downwards direction. The deflection surface 22 of the whipstock 20 causes the mill 10 to create a sidetrack 6 in the wellbore 1 as shown in FIG. 8D and as would be appreciated by one of ordinary skill in the art having the benefit of this disclosure. While the assembly 100D of FIGS. 8A-8D requires the tripping of a retrieval mechanism down the drill string 4 to retrieve the snorkel tube 30, the method does not require the tripping of the mill 10 down the wellbore 1 after the removal of the snorkel tube 30.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. An assembly for use to cement an uncased wellbore, the assembly comprising:

a whipstock having a bore and a deflection surface to deflect a mill to move substantially lateral from the deflection surface;

a mill selectively connected to an upper end of the whipstock, the mill having a bore;

a snorkel tube positioned within the bore of the mill and positioned within the bore of the whipstock, wherein cement may be pumped through the snorkel tube to a location below the whipstock; and a plug for pumping down a drill string and landing within the bore of the mill.

2. The assembly of claim 1, the snorkel tube being comprised of a drillable material.

3. The assembly of claim 2, wherein the snorkel tube is comprised of aluminum or a composite material.

4. The assembly of claim 1, further comprising:

a seal sub connected to a bottom end of the whipstock, the seal sub having a bore, wherein the snorkel tube extends into the bore of the seal sub;

a pup joint having a bore connected beneath the seal sub, wherein the snorkel tube extends into the bore of the pup joint;

an open hole anchor having a bore in communication with the snorkel tube, the open hole anchor connected beneath the pup joint.

5. The assembly of claim 4, further comprising:

a landing collar connected beneath the open hole anchor, the landing collar having a bore in communication with the bore of the open hole anchor;

a float collar connected beneath the landing collar, the float collar having a bore in communication with the bore of the landing collar; and a tail pipe connected beneath the float collar, the tail pipe having a bore in communication with the bore of the float collar, wherein cement may be pumped through the snorkel tube, the open hole anchor, the landing collar, the float collar, and out the tail pipe.

6. The assembly of claim 1, further comprising a shearable device, wherein the shearable device selectively connects the mill to the upper end of the whipstock.

7. The assembly of claim 1, wherein an end of the plug comprises a cutting structure.

8. The assembly of claim 1, further comprising a locking device that selectively secures the snorkel tube within the bore to the mill.

9. The assembly of claim 8, further comprising a releasing device pumped down a drill string to selectively unlock the locking device.

10. The assembly of claim 9, wherein the unlocked locking device prevents the downward movement of the snorkel tube within the bore of the mill and permits the upward movement of the snorkel tube within the bore of the mill.

11. The assembly of claim 10, the snorkel tube further comprising a plurality of fins on an exterior surface.

12. The assembly of claim 1, further comprising an upper end of the snorkel tube having a profile, wherein the snorkel tube may be removed from the bore of the mill via slickline, wireline, or a braided line.

13. A method of cementing through a whipstock and creating a sidetrack to a wellbore in a single trip, the method comprising:

setting an open hole anchor of an assembly connected to a drill string within an open hole portion of the wellbore, the assembly comprising a mill selectively connected to an upper end of the whipstock, a snorkel tube positioned within a bore of the mill and positioned within a bore of the whipstock, the open hole anchor having a bore in communication with the snorkel tube, and a tail pipe connected beneath the open hole anchor, the tail pipe having a bore in communication with the snorkel tube;

pumping cement down the drill string, through the snorkel tube, and out the tail pipe;

releasing the mill from the upper end of the whipstock;

cutting the sidetrack in the wellbore with the mill;

pumping a plug down the drill string after releasing the mill from the upper end of the whipstock;

landing the plug in the bore of the mill; and cutting off a portion of the snorkel tube with the mill prior to cutting the sidetrack in the wellbore.

14. The method of claim 13, releasing the mill from the upper end of the whipstock further comprises shearing a shearable device that selectively connected the mill to the upper end of the whipstock.

15. The method of claim 13, further comprising cutting off a portion of the snorkel tube with the mill prior to cutting the sidetrack in the wellbore.

16. The method of claim 13, wherein an end of the plug comprises a cutting surface.

17. The method of claim 13, wherein the snorkel tube is selectively connected to the bore of the mill and further comprising:

pumping a release device down the drill string to selectively release the snorkel tube from the bore of the mill after releasing the mill from the upper end of the whipstock, wherein the release device permits the snorkel tube to move upwards within the bore of the mill and prevents the snorkel tube from moving downwards within the bore of the mill; and pumping the snorkel tube up the drill string prior to cutting the sidetrack in the wellbore.

18. The method of claim 13, further comprising retrieving the snorkel tube from the bore of the mill after releasing the mill from the whipstock and prior to cutting the sidetrack in the wellbore.

19. The method of claim 18, retrieving the snorkel tube from the bore of the mill further comprising engaging a profile on an upper end of the snorkel tube with wireline, slickline, or a braided line.

20. A method of cementing an openhole wellbore through a whipstock and creating a sidetrack in a single trip, the method comprising:

setting an open hole anchor of an assembly connected to a drill string within an open hole portion of the wellbore, the assembly comprising a mill selectively connected to an upper end of the whipstock by a shearable device, a snorkel tube positioned within a bore of the mill and positioned within a bore of the whipstock, and the open hole anchor, wherein the drill string is connected to the mill;

pumping cement down the drill string and through the snorkel tube and the open hole anchor to cement a portion of the open hole wellbore;

shearing the shearable device to release the mill from the upper end of the whipstock;

releasing the snorkel tube from the bore of the mill after pumping cement down the drill string and after releasing the mill from the upper end of the whip stock;

moving the mill uphole within the wellbore;

milling a portion of the snorkel tube that extends above the whipstock;

engaging a diverting surface of the whipstock with the mill; and cutting the sidetrack in the wellbore with the mill.

21. A method of cementing an openhole wellbore through a whipstock and creating a sidetrack in a single trip, the method comprising:

pumping cement down a drill string and through a snorkel tube of an assembly connected to the drill string to cement a portion of the open hole wellbore, the assembly comprising a mill selectively connected to an upper end of the whipstock by a shearable device, the snorkel tube positioned within a bore of the mill and positioned within a bore of the whipstock, wherein the drill string is connected to the mill;

shearing the shearable device to release the mill from the upper end of the whipstock; and moving the mill uphole within the wellbore along with the snorkel tube positioned within the bore of the mill; and releasing the snorkel tube from the bore of the mill after moving the mill uphole.

22. The method of claim 21, further comprising pumping the snorkel tube up the drill string.

* * * * *